United States Patent [19]

Newton et al.

[11] Patent Number: 4,479,350

[45] Date of Patent: Oct. 30, 1984

[54] RECOVERY OF POWER FROM VAPORIZATION OF LIQUEFIED NATURAL GAS

[75] Inventors: Charles L. Newton, Bethlehem; Dennis L. Fuini, Schnecksville, both of Pa.

[73] Assignee: Air Products and Chemicals, Inc., Allentown, Pa.

[21] Appl. No.: 241,184

[22] Filed: Mar. 6, 1981

[51] Int. Cl.[3] ..... F01K 23/02; F01K 25/10

[52] U.S. Cl. ..... 60/655; 60/648; 60/659; 60/671

[58] Field of Search ..... 60/648, 655, 651, 671, 60/659; 62/52, 514 R

[56] References Cited

U.S. PATENT DOCUMENTS

| | | | |
|---|---|---|---|
| 2,975,607 | 3/1961 | Bodle | 62/52 |
| 3,068,659 | 12/1962 | Marshall, Jr. | 62/52 |
| 3,183,666 | 5/1965 | Jackson | 60/38 |
| 3,293,850 | 12/1966 | Morrison | 60/59 |
| 3,479,832 | 11/1969 | Sarsten et al. | 62/52 |
| 3,892,103 | 7/1975 | Antonelli | 60/648 |
| 3,992,891 | 11/1976 | Pocrnja | 62/53 |
| 4,372,124 | 2/1983 | Newton et al. | 60/648 |
| 4,429,536 | 2/1984 | Nozawa | 60/648 |

FOREIGN PATENT DOCUMENTS

| | | | |
|---|---|---|---|
| 465802 | 5/1937 | United Kingdom | 60/671 |

*Primary Examiner*—William R. Cline
*Assistant Examiner*—John F. McNally
*Attorney, Agent, or Firm*—Geoffrey L. Chase; E. Eugene Innis; James C. Simmons

[57] ABSTRACT

Power is recovered from the vaporization of natural gas by warming the natural gas against a multicomponent stream which is cooled and liquefied. The liquefied multicomponent stream is pumped to an elevated pressure and is warmed against one or more streams of propane which are cooled and liquefied. The warmed multicomponent stream is heated, expanded through a generator loaded expander and recycled. The liquefied propane is pumped to an elevated pressure in single or multi-staged streams, vaporized, expanded through a second generator loaded expander and recycled.

11 Claims, 2 Drawing Figures

RECOVERY OF POWER FROM VAPORIZATION OF LIQUEFIED NATURAL GAS

TECHNICAL FIELD

This invention relates to the recovery of power from the vaporization of liquefied natural gas.

BACKGROUND OF THE PRIOR ART

Revaporization of liquefied natural gas by means of recycling a condensing medium in heat exchange with the natural gas is disclosed in U.S. Pat. No. 3,479,832.

Recovery of power during the vaporization of liquefied natural gas by a single expansion of a condensible circulating multicomponent refrigerant is disclosed in U.S. Pat. No. 2,975,607. An improvement of this cycle is described in a paper entitled "Power Generation from Cryogenic Machinery", presented at the LNG-6 Conference held in Tokyo, Japan from Apr. 7 through 10, 1980 and authored by Shigeetsu Miyahara.

U.S. Pat. Nos. 3,293,850 and 3,992,891 disclose power recovery processes employing non-condensing gaseous heat exchange during vaporization of the liquefied natural gas.

Cascade refrigeration systems for vaporizing liquefied natural gas during which power is recovered by means of expanders are shown in U.S. Pat. Nos. 3,068,659 and 3,183,666.

BRIEF SUMMARY OF THE INVENTION

According to the present invention there is provided a method for recovering power from the vaporization of liquefied natural gas, which method comprises the steps of at least partially liquefying a multicomponent stream with the natural gas, pumping the partially liquefied multicomponent stream to an elevated pressure, warming the multicomponent stream by cooling and at least partially liquefying a single component stream, heating the multicomponent stream, expanding the heated multicomponent stream through an expander, recovering power from the expander, recycling said expanded multicomponent stream to be at least partially liquefied, pumping said at least partially liquefied single component stream to an elevated pressure, warming and vaporizing the single component stream, expanding the single component stream through an expander, recovering power from the expander, and recycling the expanded single component stream to be at least partially liquefied by the natural gas and multicomponent stream.

The present invention also provides an installation for recovering power from the vaporization of liquefied natural gas, which installation comprises a main heat exchanger in which the liquefied natural gas can be warmed by cooling and at least partially liquefying a multicomponent stream, a pump for pressurizing the partially liquefied multicomponent stream, at least one heat exchanger in which the liquefied multicomponent stream can be warmed by cooling and at least partially liquefying a single component stream, means for heating the multicomponent stream, an expander for expanding the heated multicomponent stream, a conduit for recycling the multicomponent stream from the expander to the main heat exchanger, a pump for pressurizing the partially liquefied single component stream, means for heating the single component stream to produce a vapor, an expander through which the vapor can be expanded, a conduit for recycling the expanded single component to the heat exchanger, and means for recovering power from the expanders.

DETAILED DESCRIPTION OF THE INVENTION

Figure 1:
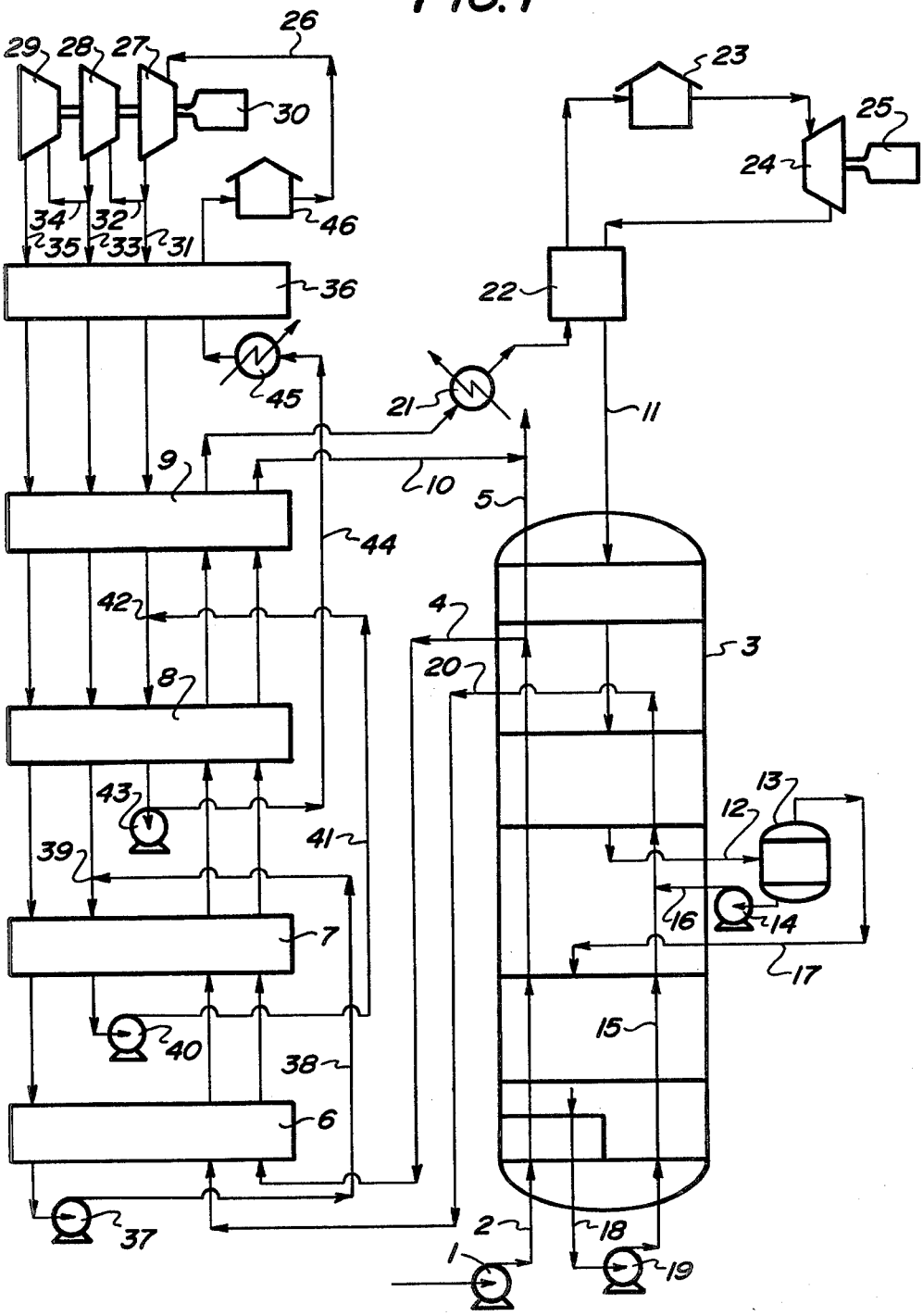
FIG. 1 is a simplified flowsheet of one embodiment of an installation in accordance with the invention.

In many parts of the world natural gas is stored in a liquefied state. We have conceived various schemes for recovering power as such liquefied natural gas is evaporated. The schemes herein described appear particularly advantageous both in terms of power recovery and in capital outlay.

According to the present invention there is provided a method for recovering power from the vaporization of liquefied natural gas, which method comprises the steps of at least partially liquefying a multicomponent stream with said natural gas, pumping said at least partially liquefied multicomponent stream to an elevated pressure, warming said multicomponent stream by cooling and at least partially liquefying a single component stream, heating said multicomponent stream, expanding said heated multicomponent stream through an expander, recovering power from said expander, recycling said expanded multicomponent stream to be at least partially liquefied, pumping said at least partially liquefied single component stream to an elevated pressure, warming and vaporizing said single component stream, expanding said single component stream through an expander, recovering power from said expander, and recycling said expanded single component stream to be at least partially liquefied by said natural gas and multicomponent stream.

Preferably, at least part of said natural gas is used to assist in cooling said single component stream.

Advantageously, said single component is expanded, condensed and pumped in a plurality of stages.

Typically, the multicomponent stream is heated to a temperature in the range of 40° F. (5° C.) to 700° F. (371° C.).

The present invention also provides an installation for recovering power from the vaporization of liquefied natural gas, which installation comprises a main heat exchanger in which said liquefied natural gas can be warmed by cooling and at least partially liquefying a multicomponent stream, a pump for pressurizing said at least partially liquefied multicomponent stream, at least one heat exchanger in which said liquefied multicomponent stream can be warmed by cooling and at least partially liquefying a single component stream, means for heating said multicomponent stream, an expander for expanding said heated multicomponent stream, a conduit for recycling said multicomponent stream from said expander to said main heat exchanger, a pump for pressurizing said at least partially liquefied single component stream, means for heating said single component stream to produce a vapor, an expander through which said vapor can be expanded, a conduit for recycling said expanded single component to said heat exchanger, and means for recovering power from said expanders.

Advantageously the installation also includes a conduit for conveying at least part of said natural gas to said heat exchanger to assist in cooling said single component stream.

The single component can be, for example, propane, propylene, butane or a fluorocarbon, such as sold by the DuPont Company under the Trademark FREON.

The multicomponent stream could comprise, for example, 2 halofluorocarbons, 2 hydrocarbons and nitrogen or 3 hydrocarbons with or without nitrogen. One preferred multicomponent stream comprises methane, ethane and propane. Another comprises methane, ethylene and propane. Other suitable hydrocarbons include propylene, butane and butylene. Particularly preferred is a mixture of methane, ethane, propane and nitrogen.

Referring to FIG. 1 of the drawing, 55265 lb. moles/hr liquefied natural gas is pumped to 1103 psia (76 bars A) by pump 1, which it leaves through conduit 2 at −254° F. (−159° C.). The liquefied natural gas, which has a composition of (mole %):

$N_2$: 0.11
$CH_4$: 86.87
$C_2H_6$: 8.68
$C_3H_8$: 3.07
$C_4$+: 1.47 is gradually warmed in coil wound heat exchanger 3.

Approximately 73% of the natural gas is withdrawn from the coil wound heat exchanger 3 through conduit 4 at −62° F. (−52° C.) as liquid. The balance of the natural gas passes through the remainder of the coil wound heat exchanger 3 which it leaves through conduit 5 as vapor at 45° F. (7° C.).

The liquefied natural gas passing through conduit 4 is progressively heated in heat exchangers 6, 7, 8 and 9 and leaves heat exchanger 9 as vapor at 45° F. (7° C.) through conduit 10. It then joins the remaining vapor in conduit 5.

37,956 lb. moles/hr of a gaseous multicomponent stream comprising (mole %):

$N_2$: 3.0
$CH_4$: 2.6
$C_2H_6$: 47.4
$C_3H_8$: 7.0 is introduced into coil wound heat exchanger 3 through conduit 11. As it passes through the coil wound heat exchanger 3 it is progressively cooled and partially liquefied. The two phase mixture thus formed is withdrawn from the coil wound heat exchanger 3 through conduit 12 at −115° F. (−82° C.) and is introduced into phase separator 13. Liquid from the phase separator (17,430 lb. moles/hr) is pumped to 760 psia (52.4 bars A) by pump 14 and is introduced into conduit 15 via conduit 16. Vapor from the phase separator is returned to the coil wound heat exchanger 3 via conduit 17 and is totally liquefied when it leaves the coil wound heat exchanger 3 through conduit 18. It is then pumped to 790 psia (54.5 bars A) by pump 19 which it leaves through conduit 15. The liquid is progressively warmed as it passes through the coil wound heat exchanger 3 which it leaves through conduit 20 at −62° F. (−52° C.) and 730 psia (50.4 bars A) as a totally liquid stream.

The liquid in conduit 20 is progressively warmed in heat exchangers 6, 7, 8 and 9 and leaves heat exchanger 9 at 13.3° F. (−8.7° C.) as a two phase mixture containing approximately equimolar quantities of liquid and vapor. Almost all the remaining liquid is vaporized in heat exchanger 21 which is warmed by sea water and from which the multicomponent stream emerges at 45° F. (7.2° C.). The multicomponent stream is then heated to 396° F. (202° C.) in heat exchanger 22 and to 650° F. (343° C.) in heater 23 which is fired by natural gas. The multicomponent stream leaving heater 23 is then expanded from 690 psia (47.6 bars A) to 91 psia (6.3 bars A) across expander 24 which is coupled to a generator 25. The multicomponent stream leaves the expander 24 at 456° F. (235° C.) and is further cooled to 50° F. (10° C.) in heat exchanger 22 which it leaves at 85 psia (5.9 bars A) via conduit 11.

Turning now to the top left of FIG. 1, 24,972 lb. moles/hr propane at 75 psia (5 bars A) and 650° F. (343° C.) are passed through conduit 26 to a three stage expander having a first stage 27, a second stage 28 and a third stage 29 each of which is coupled to a generator 30.

The propane is expanded to 55 psia (3.8 bars A) in the first stage 27 and is then divided between two conduits 31 and 32. Approximately 26% of the propane passes through conduit 31 while the balance passes through conduit 32 to second stage 28 where it is expanded to 33 psia (2.3 bars A). The propane leaves the second stage 28 at 603° F. (317° C.) and is divided between two conduits 33 and 34. Approximately 22% of the propane passes through conduit 33 while the balance passes through conduit 34 to third stage 29 where it is expanded to 20 psia (1.4 bars A) before leaving through conduit 35.

The propane in conduit 35 is passed through heat exchangers 36, 9, 8, 7 and 6, wherein it is progressively cooled and liquefied. It is then pumped to 30 psia (2.1 bars A) by pump 37 which it leaves through conduit 38 en route to conduit 33 via junction 39.

The propane in conduit 33 is passed through heat exchangers 36, 9, and 8 wherein it is progressively cooled and partially liquefied. It is then joined by liquid propane at junction 39 and the combined stream is passed through heat exchanger 7 where the remaining gaseous propane is liquefied. The liquid propane is then pumped to 52 psia (3.6 bars A) by pump 40 and is passed through conduit 41 at −12° F. (−24° C.) to junction 42.

Propane from conduit 31 is passed through heat exchangers 36 and 9 wherein it is cooled. It is then joined by liquid propane at junction 42 and the combined stream is totally liquefied in heat exchanger 8. The liquid is then pumped to 90 psia (6.2 bars A) by pump 43 which it leaves through conduit 44. The liquid propane is then totally vaporized against sea water in heat exchanger 45 which the gaseous propane leaves at 45° F. (7.2° C.). It is then heated to 596° F. (313° C.) in heat exchanger 36 and is further heated to 650° F. (343° C.) in heater 46 which it leaves at 75 psia (5 bars A).

Various modifications to the installation described with reference to the drawings can be made. For example, whereas the propane expander has three stages of expansion it could have more or less stages with a corresponding change in the number of pumps and the number of heat exchangers. In general, the higher the number of stages the better the power recovery at generator 30 but the higher the capital cost. The arrangement shown represents a reasonable compromise between capital cost and power recovery. Alternatively, stream 11 may be subjected to a plurality of condensations followed by phase separation, such as illustrated by separator 13, as the stream 11 passes from the warm to the cold end of heat exchanger 3. Each additional stage would require its own pump and again a balance must be found between efficiency and capital cost. Stream 11 may be completely condensed in heat exchanger 3 without intermediate separation. Complete elimination of the separator would require alteration of the composition of the multicomponent stream to a less optimum composition with less power recovering efficiency.

The propane used in conduit 26 may be replaced by propylene, butane and the fluorocarbon refrigerants such as those sold by the Dupont Company under the FREON trademark.

Similarly, the multicomponent refrigerant could conceivably comprise, for example, 2 halofluorocarbons, 2 hydrocarbons and nitrogen or 3 or more hydrocarbons with or without nitrogen.

In the installation described in FIG. 1 the generators produced a total 43800 kW of energy.

Figure 2:
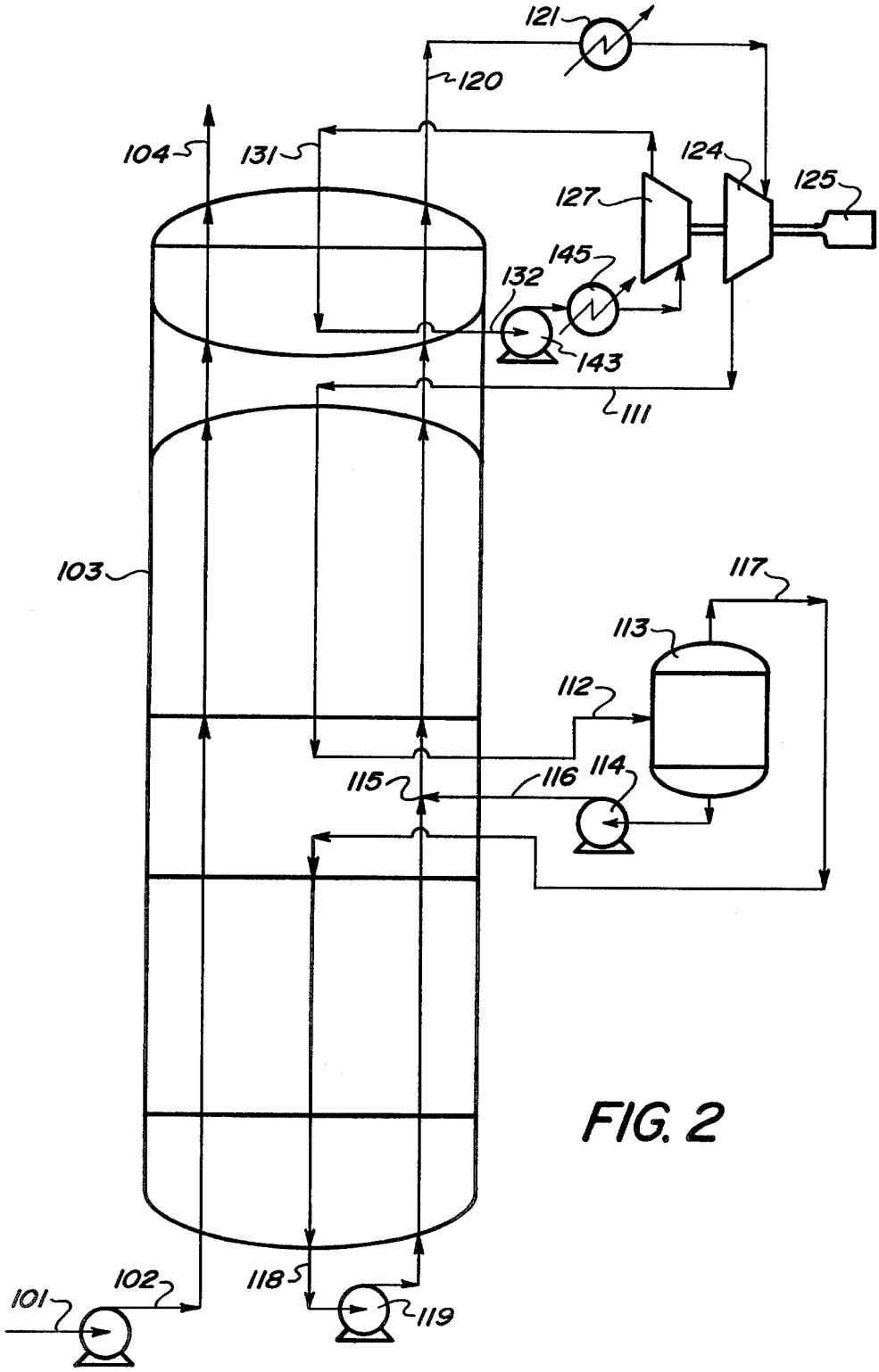
FIG. 2 is a simplified flowsheet of a second embodiment of an installation in accordance with the invention.

Referring now to FIG. 2, 34,410 lb. moles/hr liquefied natural gas is pumped to 1347 psia (92.9 bars A) by pump 101 which it leaves through conduit 102 at −246° F. (−159° C.). The liquefied natural gas which has a composition of (mole %):

$N_2$: 0.05
$CH_4$: 96.96
$C_2H_6$: 1.61
$C_3H_8$: 0.7
$C_4$+: 0.68 is gradually warmed in coil wound heat exchanger 103 which it leaves through conduit 104 at −28.7° F. (−34° C.) as vapor.

32,077 lb. moles/hr of a gaseous multicomponent stream comprising (mole %):

$N_2$: 0.9
$CH_4$: 43.4
$C_2H_6$: 47.5
$C_3H_8$: 8.2 is introduced into coil wound heat exchanger 103 through conduit 111. As it passes through the coil wound heat exchanger 103 it is progressively cooled and partially liquefied. The two phase mixture thus formed is withdrawn from the coil wound heat exchanger 3 through conduit 112 at −186° F. (−121° C.) and is introduced into phase separator 113. Liquid from the phase separator (28709 lb. moles/hr) is pumped to 310 psia (21.4 bars A) by pump 114 and is introduced into conduit 115 via conduit 116. Vapor from the phase separator 113 is returned to the coil wound heat exchanger 103 via conduit 117 and is totally liquefied when it leaves the coil wound heat exchanger 103 through conduit 118. It is then pumped to 340 psia (23.5 bars A) by pump 119 which it leaves through conduit 115. The liquid is progressively warmed as it passes through the coil wound heat exchanger 103. It joins with liquid from conduit 116 and the combined stream leaves coil wound heat exchanger 103 through conduit 120 at −29° F. (−34° C.) as a two phase mixture containing approximately 25% (by moles) liquid. The remaining liquid is totally vaporized and the gas heated to 50° F. (10° C.) by indirect heat exchange with sea water in heat exchanger 121. The heated gas is then expanded to 89 psia (6.1 bars A) through expander 124 and leaves at −28° F. (−33° C.) through conduit 111.

Turning now to the propane cycle, 11,165 lb. moles/hr gaseous propane at 25 psia (1.7 bars A) and −9° F. (−23° C.) enters main heat exchanger 103 via conduit 131. The propane is totally liquefied and leaves the main heat exchanger 103 through conduit 132 as liquid at −22° F. (−30° C.). It is then pumped to 89 psia (6.1 bars A) by pump 143 before being vaporized by indirect heat exchange with sea water in heat exchanger 145. The resulting vapor at 50° F. (10° C.) is expanded through expander 127 and the expanded gas is recycled through conduit 131 as shown.

In the installation in FIG. 2 the generator 125 driven by expanders 124 and 127 provides a total 7129 kW of energy using 60° F. (15.6° C.) sea water. 9481 KW is generated with 120° F. (49° C.) heating water temperature.

What is claimed is:

1. A method for recovering net power from the vaporization of liquefied natural gas, which method comprises the steps of at least partially liquefying a multicomponent stream and a single component stream with said natural gas, pumping said at least partially liquefied multicomponent stream to an elevated pressure, warming said multicomponent stream by cooling and assisting in at least partially liquefying said single component stream, heating said multicomponent stream, expanding said heated multicomponent stream through an expander, recovering power from said expander, recycling said expanded multicomponent stream to be at least partially liquefied, pumping said at least partially liquefied single component stream to an elevated pressure, warming and vaporizing said single component stream, expanding said single component stream through an expander, recovering power from said expander, and recycling said expanded single component stream to be at least partially liquefied by said multicomponent stream.

2. A method according to claim 1 wherein said single component is expanded in a plurality of stages.

3. A method according to claim 1 wherein said multicomponent stream is heated to a temperature in the range of 40° F. (5° C.) to 700° F. (371° C.).

4. A method according to claim 2 wherein said multicomponent stream is heated to a temperature in the range of 40° F. (5° C.) to 700° F. (371° C.).

5. An installation for recovering net power from the vaporization of liquefied natural gas, which installation comprises a main heat exchanger in which said liquefied natural gas can be warmed by cooling and at least partially liquefying a multicomponent stream and a single component stream, a pump for pressurizing said at least partially liquefied multicomponent stream, at least one heat exchanger in which said liquefied multicomponent stream can be warmed by cooling and assisting in at least partially liquefying said single component stream, means for heating said multicomponent stream, an expander for expanding said heated multicomponent stream, a conduit for recycling said multicomponent stream from said expander to said main heat exchanger, a pump for pressurizing said at least partially liquefied single component stream, means for heating said single component to produce a vapor, an expander through which said vapor can be expanded, a conduit for recycling said expanded single component stream to said heat exchanger, and means for recovering power from said expanders.

6. A method according to claim 1 wherein said single component is propane.

7. A method according to claim 2 wherein said single component is propane.

8. A method according to claim 3 wherein said single component is propane.

9. An installation according to claim 5 wherein said single component is propane.

10. A method according to claim 1 wherein said at least partially liquefied multicomponent stream is phase separated into a liquid phase stream and a vapor phase stream, the vapor phase stream is liquefied against said vaporizing natural gas, the liquefied vapor phase stream is pumped to an elevated pressure and the two streams are combined into an elevated pressure, liquid multicomponent stream.

11. An installation according to claim 5 including a phase separator for separating a liquid phase stream and a vapor phase stream from said at least partially liquefied multicomponent stream, a second pump for pressurizing the liquefied vapor phase stream and means combining the two liquefied multicomponent streams.

* * * * *